United States Patent [19]

Simms et al.

[11] Patent Number: 4,990,766

[45] Date of Patent: Feb. 5, 1991

[54] SOLID STATE ELECTRON AMPLIFIER

[75] Inventors: Robert A. Simms, Phoenix, Ariz.; Charley B. Burgett, Santa Barbara, Calif.

[73] Assignee: Murasa International, Long Beach, Calif.

[21] Appl. No.: 354,714

[22] Filed: May 22, 1989

[51] Int. Cl.[5] ..... H01J 5/16

[52] U.S. Cl. ..... 250/213 VT; 313/336

[58] Field of Search ..... 250/213 VT; 213/542, 213/543, 527, 541; 313/336, 351, 309, 444

[56] References Cited

U.S. PATENT DOCUMENTS

| | | | |
|---|---|---|---|
| 3,068,360 | 12/1962 | Nicoll | 250/213 VT |
| 3,755,704 | 8/1973 | Spindt et al. | 313/336 |
| 4,827,177 | 5/1989 | Lee et al. | 313/336 |

OTHER PUBLICATIONS

Journal of Applied Physics, vol. 47, No. 12, Dec. 1976, pp. 5248 to 5263.

Applications of Surface Science, vol. 16, (1983), pp. 268 to 276.

*Primary Examiner*—David C. Nelms

*Assistant Examiner*—Que Tan Le

*Attorney, Agent, or Firm*—LaValle D. Ptak

[57] ABSTRACT

A microscopic voltage controlled field emission electron amplifier device consists of a dense array of field emission cathodes with individual cathode impedances employed to modulate and control the field emission currents of the device. These impedances are selected to be sensitive to an external stimulus such as light, x-rays, infrared radiation or particle bombardment; so that the field emission current varies spacially in proportion to the intensity of the controlling stimulus. When a phosphorus screen or other suitable responsive element is provided, the device functions as a solid state image convertor or intensifier.

49 Claims, 2 Drawing Sheets

SOLID STATE ELECTRON AMPLIFIER

BACKGROUND

Microscopic voltage controlled field emission cathode-anode structures have been fabricated as individual units and in high density arrays including thousands of devices. Such field emission cathode arrays are constructed in accordance with advanced semiconductor microfabrication technology, including thin film deposition, photolithography, electron lithography, and wet and dry etching processes. Packing densities of $1.2\times10^6$ tips per square centimeter and more have been achieved. Small arrays with the same packing density also have been constructed.

Prior art field emission cathode arrays operate all of the field emission devices in parallel, and the multiple tip arrays have been used for high current density operations. The devices are mounted in a high vacuum housing to avoid disruptions of the emitter cathodes during operation. Thus, field emission cathode array devices comprise miniature vacuum devices. Applications for such devices, however, have been limited; and much work on field emission cathode array devices has been restricted to laboratory experiments.

Fabrication and operating characteristics of known field emission cathode devices utilizing molybdenum cathode cones are described in the technical articles by Charles A. Spindt, et al., in the JOURNAL OF APPLIED PHYSICS, Volume 47, Number 12, December, 1976, Pages 5248 to 5263, and APPLICATIONS OF SURFACE SCIENCE 16 (1983), Pages 268 to 276. The field emission cathode arrays described in those articles essentially comprise of a silicon substrate which has a thermally grown silicon dioxide film on it. A molybdenum anode or gate film is deposited on the surface of the silicon dioxide film. A microscopic array of holes then is micromachined through the anode or gate film and the silicon dioxide layer to the underlying silicon substrate. Molybdenum cones then are formed on the silicon substrate by electron beam evaporation or other suitable technique to produce sharp pointed cone cathodes on the silicon substrate. The tips of the cones are centered in the holes and are located in the plane of the molybdenum anode or gate film. The tips are formed in all of the holes simultaneously by a combination of physical deposition processes, so that the number and packing density of the tips depends only on the number and packing density of the holes which can be formed in the structure. A process or fabricating such devices is described clearly in the abovementioned JOURNAL OF APPLIED PHYSICS article.

The application of a suitable electrical bias between the silicon substrate and the gate film layer, after the array is mounted in a vacuum, causes the emission of electrons from the field emission cathodes. These emitted electrons then are directed to a collector to permit the electron flux thus produced by the array to be used as the electron source for a variety of different electronic devices. The electron flux or current depends strongly upon the bias voltage between the cathode and gate or anode. This current also is dependent upon the sharpness or radius of curvature of the field emission cathode cones. For low voltages, little or no electron current flows, and the current increases sharply with increasing voltage.

Field emission cathode devices have been used as discrete point cathodes as electron sources for scanning electron microscopes. These devices have the advantage of high brightness (electron flux density) and simplicity, since the devices do not require a heating circuit as is required for thermionic cathodes. A significant disadvantage for conventional field emission cathode devices is the extreme sensitivity to residual gas in the vacuum. As a consequence, ultra high vacuum levels have been required, in the range of $10^{-9}$ TORR to prevent ionic bombardment and erosion of the cathode.

An advantage of the microscopic field emission cathode array structures described in the above-identified articles by Spindt et al. is that such ultra high vacuum levels are not required, because the accelerating voltages are small for the microscopic distances involved. In addition, arrays of cathodes including millions of structures are feasible, utilizing the technology described in the Spindt articles.

Accordingly, it is desirable to incorporate the advantages of the high packing densities, relatively low vacuum requirements, and the other inherent advantages of microscopic field emission cathode arrays in configurations which also permit individual control of each of the field emission cathodes of an array independently of the other field emission cathodes in the same array.

SUMMARY OF THE INVENTION

Accordingly, it is an object of this invention to provide an improved field emission cathode device.

It is another object of this invention to provide an improved field emission cathode array in which the current conductivity of each cathode of the array is independently controlled.

It is an additional object of this invention to provide a variable impedance in series with each cathode of a field emission cathode array for independently controlling the current flow through such cathode of the array.

It is a further object of this invention to provide an improved solid state field emission cathode device.

It is yet another object of this invention to provide an improved solid state field emission cathode device which includes a variable impedance in series with the cathode for varying the current density of the field emission cathode in accordance with a stimulus applied to the impedance to vary the impedance thereof.

In accordance with a preferred embodiment of the invention, a solid state electron amplifier includes a substrate with a conductor on it. A field emission electron emitter cathode with an enlarged base and a pointed tip is provided with a impedance in series electrical circuit between the conductor and the base of the cathode. An anode or gate member is spaced from the cathode, and an electrical bias voltage is provided between the conductor and the anode or gate member. In a more specific embodiment of the invention, the amplifier comprises an array of a plurality of field emission electron emitter cathode members. Separate variable impedances are provided between the conductor and the bases of each of the field emission cathodes of the array, and the impedance of the variable impedances is individually varied in accordance with an external stimulus.

DETAILED DESCRIPTION

Reference now should be made to the drawings in which the same reference numbers are used throughout the different figures to designate the same or similar components.

Figure 1:
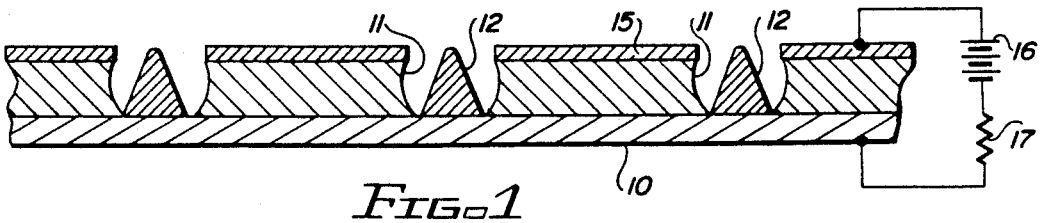
FIG. 1 (PRIOR ART)
FIG. 1 shows a cross-section of a typical prior art solid state field emission cathode array.

FIG. 1 shows a cross-section of a typical prior art thin film field emission cathode array device of the type described in the above-mentioned Spindt et al. articles. The array of FIG. 1 includes a silicon substrate 10 which has a silicon dioxide insulating layer 11 grown on its surface. A film of molybdenum gate or anode material 15 is vacuum deposited on the silicon dioxide layer 11 to provide the gate electrode for the array. Standard solid state fabrication techniques then are used to form circular holes through the anode layer 15 and the silicon dioxide spacer 11 to the surface of the silicon substrate 10. Molybdenum cones 12 then are deposited by standard suitable techniques, such as electron beam evaporation, to form the individual pointed tip cathodes of the device. Such arrays typically then are biased from a suitable direct current source 16 through a current limiting impedance 17 interconnected between the substrate 10 and the anode or gate layer 15.

When these arrays are placed in a vacuum container, the conductivity may be varied in accordance with the techniques disclosed in the above-mentioned articles. It is to be noted that the device of FIG. 1 operates all of the emitter cathodes 12 in parallel, irrespective of the number of devices included in the total array.

Figure 2:
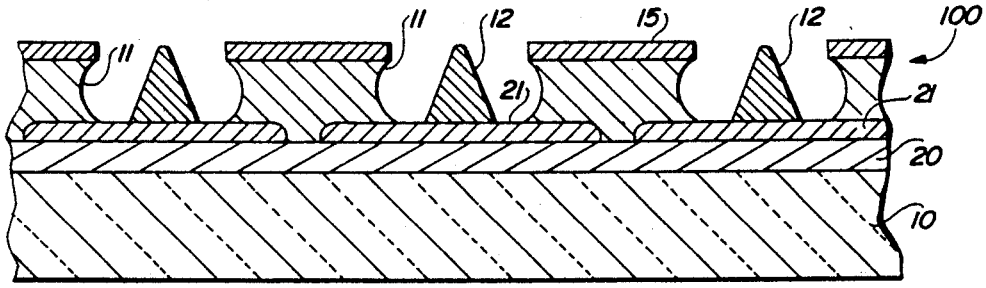
FIG. 2 is a cross-section of a preferred embodiment of the invention.
Figure 3:
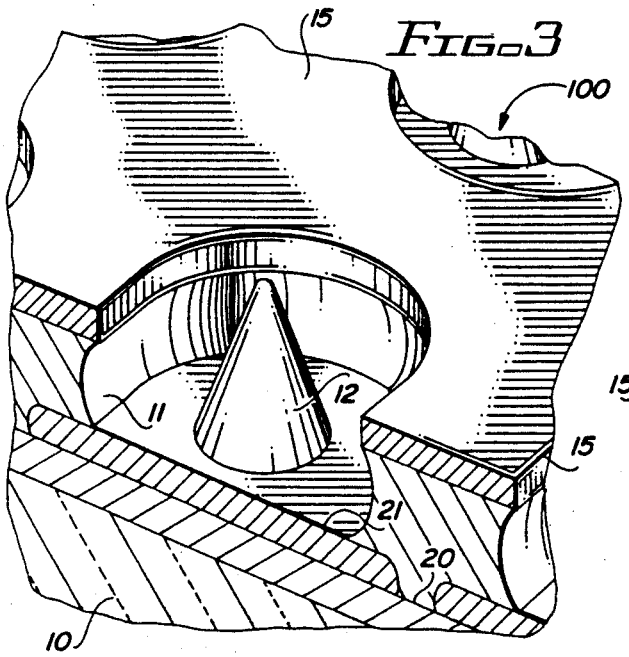
FIG. 3 is a partially cut-away perspective view of a portion of an array of the type shown in FIG. 2.
Figure 4:
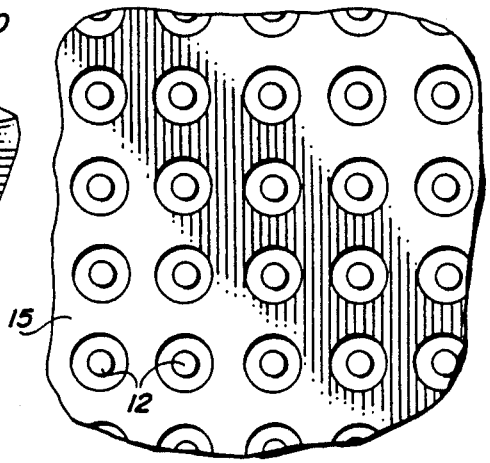
FIG. 4 is a top view of the embodiment shown in FIGS. 2 and 3.

FIGS. 2, 3, and 4, illustrate a preferred embodiment of the invention which incorporates additional structural features to permit individual control of the current density of the current emitted by each of the individual emitter cathodes 12 of an array similar in some respects to the one illustrated in FIG. 1. The array of FIG. 2, however, differs from the one of FIG. 1 in several important aspects. As illustrated in FIGS. 2 and 3, in particular, the substrate 10 has the upper surface thereof covered with a deposited metal conductive layer 20. On the surface of the layer 20, individual variable impedances 21 are formed prior to the deposition of the silicon dioxide layer 11. These impedances 21 are of a generally circular configuration with a greater diameter than the diameter of the opening through the silicon dioxide layer 11. The molybdenum cathodes 12 then are formed on the upper surfaces of the impedances 21.

The structure of the array shown in FIGS. 2, 3, and 4, is accomplished by employing standard solid state circuit fabrication techniques. As illustrated, the structure is a planar structure consisting of a large number of individual arrays (portion of one of which is shown in the top view of FIG. 4) in the form of a deposited stack of materials built up in planar fashion on a common substrate 10. The substrate 10 is selected to be transparent to a stimulus capable of varying the impedance of the individual variable impedances 21 which are deposited emitting cathodes 12. Suitable substrate materials include Gallium arsenide, germanium, glass, quartz, sapphire, diamond, various ceramics (such as those which are transparent to infrared rays), and the like.

In the embodiment illustrated in FIGS. 2 through 4, the metal conductive layer 20 also is transparent to the same stimulus. The metal layer 20 may be a continuous thin film metal film or may comprise metallized traces which are deposited on the surface of the substrate 10. The manner of constructing the device of FIGS. 2 through 4 is similar to the manner of the construction of the device of FIG. 1, with the addition of the processing steps necessary to place the metal layer 20 and the individual impedances 21 in the structure.

For a typical operating device, the substrate 10, made of the materials described above, has a thickness between twenty and forty mils. The conductive metal layer 20 has a thickness on the order of four-thousand Angstroms and typically, is gold, nickel or tungsten. The impedances 21 have a thickness between a fraction of a micron to ten microns, and the material of the impedances 21 is selected to be responsive to the particular stimulus (visible light, infrared light, heat, pressure, temperature, photoelectrons, X-rays, etc.) used to control the device. Typical impedance thicknesses range from a fraction of a micron to ten microns. The silicon dioxide dielectric layer 11 has a typical thickness of one to three microns, and the anode or gate layer 15 has a thickness of 0.5 to one mircon. Typically, the anode or gate layer 15 is made of molybdenum, titanium/ tungsten titanium/gold, or titanium/chromium. The various materials and the relative and absolute thicknesses of these materials may be varied in accordance with desired operating characteristics, but the materials and thicknesses described above have been found acceptable in other field emitter arrays.

Figure 5:
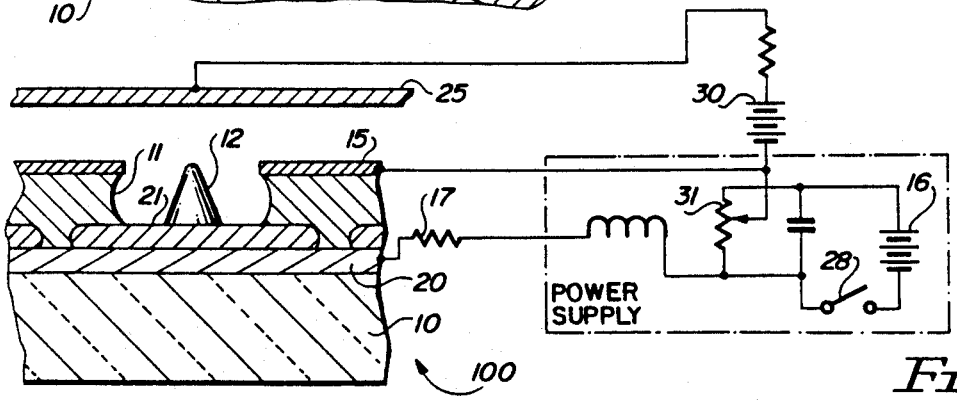
FIG. 5 illustrates electrical bias circuitry and a utilization device interconnected with the embodiment shown in FIGS. 2 through 4.

FIG. 5 illustrates the electrical interconnections of a bias circuit which may be employed in conjunction with the embodiment of FIGS. 2 through 4. A power supply, having a battery 16 and a current limiting impedance 17, similar to the correspondingly numbered elements of FIG. 1, is provided. An on/off switch 28 is used to control the power supply. In addition, FIG. 5 illustrates an additional bias provided by a battery 30 between the anode or gate layer 15 and a suitable collector 25 which may be a phosphor screen 25 or other suitable device. The bias between the anode or gate 15 and the screen 25 is varied through a variable impedance 31 to establish the desired operating characteristics of the device. The settings shown in FIG. 5 are utilized to provide the operating bias of an overall array. This bias circuitry is similar to that which has been employed with the parallel operated arrays of the prior art. The device of FIG. 5, however, differs significantly from the prior art arrays, since the individual conductivity of each of the field emission cathodes 12 is varied in accordance with the impedance of the individual variable impedance 21 connected in series electrical circuit with the associated field emission cathode 12.

Figure 6:
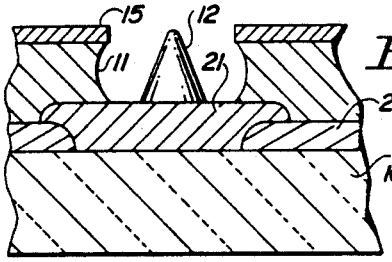
FIGS. 6 and 7 are cross-sectional views of a variation of the embodiment shown in FIG. 2.
Figure 7:
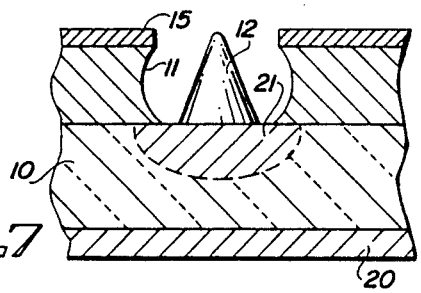

FIGS. 6 and 7 are partial cross-section illustrations of variations of the embodiment shown in cross-section in FIG. 2. The operation of the devices shown in FIGS. 6 and 7 are identical to the operation of the device shown in FIG. 2. In FIG. 6, however, the conductive layer 20 is constructed g similar to the construction of the layer 15, shown most clearly in FIGS. 3 and 4, since it has a plurality of circular holes formed in it by means of standard solid state semiconductor fabrication techniques. The variable impedances 21 then are deposited in the holes in the layer 20 or otherwise formed in these holes, so that the bottoms of the impedances 21 are in direct contact with the upper surface of the transparent substrate 10, as illustrated. In all other respects, the device of FIG. 6 is the same as the device of FIG. 2 and it is operated in the same manner as the device of FIG. 2.

The device of FIG. 7 shows the formation of the variable impedances 21 as an integral part of the substrate 10. This is accomplished by suitable doping of the substrate 10 in the areas where subsequent formation of the field emission cathodes 12 is to take place. Again, the formation of the device of FIG. 7 is accomplished by means of standard photolithographic methods, and the surfaces of the impedances 21 which are formed in the substrate 10 becomes the individual surfaces for deposition of the cathode-anode structures in the manner described previously. In the device of FIG. 7, the metal conductor 20 is placed on the lower surface of the substrate 10. The layer 20 is transparent to the stimulus which is employed to vary the impedance of the impedances 21, as described above in conjunction with the embodiment of FIGS. 2 through 4.

Figure 8:
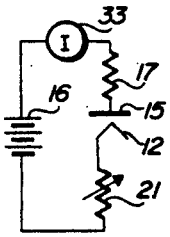
FIG. 8 is a diagrammatic circuit diagram of the operating circuit for the embodiments of FIGS. 1 through 4, 6 and 7.

FIG 8 illustrates a simplified circuit diagram of the circuit employed in conjunction with each of the embodiments of FIGS. 2 through 7. The bias voltage is provided by the battery 16 through a current limiting impedance 17 to the anode or gate layer 15. Each individual field emission cathode 12 then is connected in series with a variable impedance 21 to the other side of the battery 16. A current measuring device 33 (to simulate a utilization device) is illustrated in the circuit of FIG. 8. This circuitry is duplicated for each of the different individual field emission cathodes 12 of the array. Each cathode 12 has an individual variable impedance 21 connected in series with it in the biasing circuit. Consequently, as the impedances of the different variable impedances 21 change relative to one another, the conductivity which is present through the cathode-anode circuits of the devices, differs directly in proportion to the impedance of the variable impedance 21. This operating phenomenon is capable of utilization in a variety of different applications. It is to be noted that, in all of these applications, the devices which are illustrated are operated in a vacuum.

Figure 9:
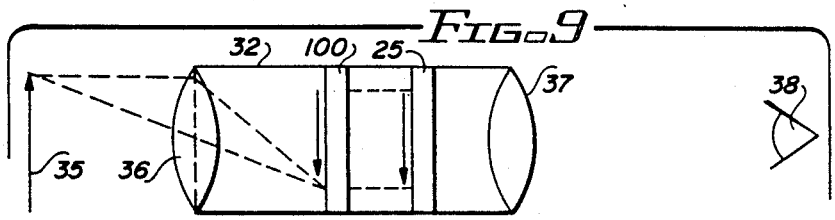
FIG. 9 illustrates a typical application of the embodiments of FIGS. 1 through 7.

FIG. 9 is a diagrammatic representation of a configuration in which the device 100 of any of the structures of FIGS. 2 through 7 may be used as a photon intensifier or image converter. As illustrated in FIG. 9, an optical scene, such as the arrow 35, is placed in the field of view of the device. This optical scene 35 may be either a visible object or one which radiates infrared radiation. A vacuum housing 32 is provided for the device. An input imaging lens 36, which may be any suitable optical lens, is placed in the device 32 to focus the optical scene on the bottom surface (as illustrated in FIGS. 2, 6 and 7) of an array 100 of the type described above. This image passes through the transparent substrate 10 and impinges upon the variable impedances 21. The imaging lens 36 may be either part of the vacuum housing or separate from it.

The variable impedances 21 are selected to be sensitive to the particular stimulus produced by the scene, that is, either visible light or infrared light. Consequently, the impedance of each of the individual impedances 21 varies in accordance with the intensity of the light impinging upon such impedances. This intensity varies in accordance with the particular part of the scene image which is focused on the substrate 10 by the input imaging lens 36. The array 100 is located in a vacuum, and the cathode emitters 12 emit varying amounts of flux density (current) as established by the impedance of the individual variable impedances 21 connected in series circuit with them. A phosphor screen 25, biased as illustrated in FIG. 5, is placed in parallel with the anode/plate 15 of the device; so that the electron flux emitted from the various emitters 12 impinges upon the screen 25. The intensity of the electron flux then causes a corresponding variation of the phosphorescence of the screen 25 to reproduce the image. The image then may be viewed through suitable viewing optics 37 by an observer 38.

It is readily apparent that the image which is viewed by the observer 38 may be substantially intensified or converted (in the case of infrared images) by the amplifying characteristics which are inherent in the operating circuit illustrated in FIG. 5. The image is an exact reproduction of the optical scene which is viewed by the device, due to the high packing density of the individual devices which are used to intensify or convert the image.

Figure 10:
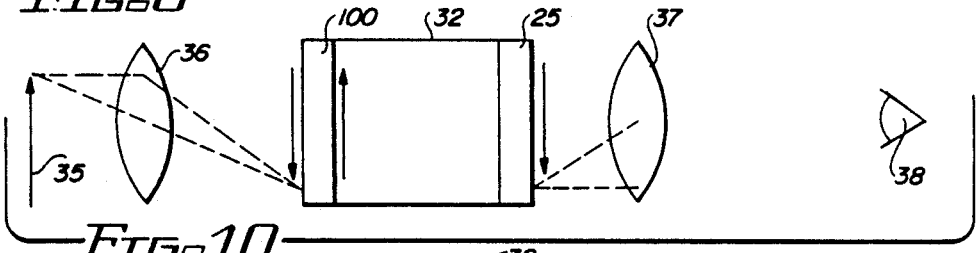
FIG. 10 illustrates another application of the embodiments of FIGS. 1 through 7.

In devices of the type shown, for example, in FIGS. 9 and 10, a need for a gain mechanism in the control impedance for the controlled field emitter device arises from the need for a total gain in the range of $10^5$ to $10^6$. This gain is best distributed between the various mechanisms available in the total system. In the case of an image convertor and image intensifier, the gain may be achieved in the photo-sensitive control resistor, in the microchannel plate amplifier (if any), and phosophor gain.

Photoconductive gain is defined as the net number of electrons per photon available at the terminals of a photoconductive device. There are several gains, but three are particularly suited for the applications described here, namely, two-carrier photoconductive gain, trapping mode gain, and electron beam induced conductivity (EBIC) gain. The range in the photoconductive gain is from a low of 200 for two-carrier photoconduction to $10^5$ for trapping mode photoconductivity. Further EBIC gain provides gains of $10^4$ with essentially noiseless amplification.

Two-carrier photoconductivity is characterized by the manner in which conduction takes place. Upon being absorbed, the photon generates an electron-hole pair. This electron-hole pair separates; and each part, the electron and hole, is free to drift in opposite directions in the applied electric field across the photoconductor, thus contributing to photoconductivity. However, if the mobility of one of the carriers is much greater than the other, the faster (majority) carrier is swept out of the device; and due to the requirement for charged neutrality within the device, a matching carrier is injected into the opposite electrode. This replacement effect continues until the slower (minority) carrier either recombines or is itself swept out of the device. This constitutes a gain mechanism, since the majority carrier effectively is making many cycles through the photoconductor. A typical gain for HgCdTe operating in this mode is 200.

Trapping mode gain occurs where the minority carrier is trapped at some electrical site in the photoconductor, such that the minority carrier lifetime is significantly longer than it otherwise would be. In this case, the majority carrier cycles through the circuit (again because of the requirement of charge neutrality within the device) until the minority carrier is released and recombines. This mechanism is used in most CdS, CdSe, ZnS and ZnSe detectors. Trapping mode gains of $10^4$, $10^5$, and even $10^6$ are common. A disadvantage for the higher gain is a longer response time. The response time is proportionally increased with the gain, for a slower device.

The final gain mechanism which is particularly suited for the applications disclosed here is electron beam induced conductivity (EBIC) gain. This gain mechanism uses the impact of high energy particles, such as electrons or other elementary particles to generate many conduction electrons per impact particle. This effect makes use of the kinetic energy of an energetic particle (electron) to distribute its high energy to many low energy conduction electrons and holes upon impact with a semiconductor. For example 10 KeV electron impacting silicon will produce over 3,000 conduction electrons, approximately 1 electron per 3 electron volts of impact energy. EBIC gain essentially is a noiseless amplification method used in some electronic devices. Induced excess carriers then can be sensed as either increased photoconductivity or as a photovoltaic current in a photodiode.

Applicability of EBIC gain to the devices described in this application is simple and direct. A reverse biased silicon photodiode may be used as the variable impedance emitter control, modulated by energetic electrons from an imaging source, such as a photocathode. An example of a practical device is a photocathode coupled to the EBIC gain controlled emitter array, with the output current of the array exciting an imaging phosphor screen. The imaged photocathode current, accelerated to high energy (typically 10 KeV) modulates the silicon photodiode array with EBIC gain of approximately 3,000. The modulated impedance controls the emitter current and, thus, the intensity of a phosphor screen. The product of all of the gains: EBIC, emitter, and phosphor screen gains may exceed 5 to 6 orders of magnitude. EBIC gain devices may be used as an electron amplifier, or as a particle to electron convertor and amplifier, using positrons, energetic ions or other elementary particles.

The foregoing gain mechanisms are applicable to the resistor controlled field emitter devices disclosed herein, since the photoconductive gain mechanism directly affects the sensitivity of resitance or impedance controlling the field emitter. The mechanism most easily implemented is that of the reverse biased silicon avalanch detector for visible imaging Other photoconductive gain mechanisms exist, but those described above are considered the most suitable FIG. 10 illustrates the device 100 of FIGS. 2 through 7 as used as a particle intensifier or particle image convertor. In the configuration shown in FIG. 10, the particle image source 35 is caused to be focused by a focusing lens 36 onto the controlled field emitter array 100 housed in the vacuum housing 32. The focusing lens 36 may be an optical lens, or it may be a collimation device if the object being focused is X-rays, or the like. The field emitter array 100 is spaced from a phosphor screen 25, much in the same manner as described above in conjunction with the embodiment of FIG. 9. Suitable viewing optics 37 are provided between the screen 25 and the observer 38. Thus, a representation is provided for the observer 38 in accordance with the particle image source. Of course, if the array 100 were multiplied, or if, in essence, each single array is "turned on" in some sequence, and if the phosphor screen 25 is replaced by a collector anode, the output from the device of FIG. 10 is a video signal instead of a direct view optical image. The gain mechanisms described above also are applicable to this implementation of the invention.

It also should be noted that if a properly collimated X-ray image 35 is caused to impinge on the array 100 by a collimating lens 36, then X-ray image convertor with attendant gain also results from the system.

Figure 11:
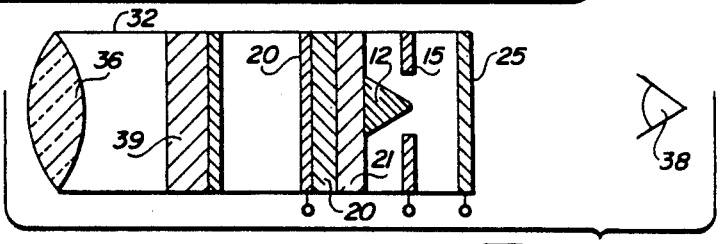
FIG. 11 illustrates a further application of the embodiments of FIGS. 1 through 7.

FIG. 11 illustrates a single field emission cathode device (which may be one out of an array including many thousands of similar devices) used in a device such as a solid state image intensifier which typically could be placed directly on eye glasses or goggles, due to the extremely small dimensions required for such devices. The device of FIG. 11 is similar to the one shown in FIG. 9, except that the input imaging lens 36 focuses the image onto a photocathode 39, of a known type, for accelerating the photoelectrons which then are applied to the field emitter cathode device illustrated. The biasing circuitry used for the device is the same as the one illustrated in FIG. 5, and the observer 38 observes the image directly on the phosphor screen 25. This configuration (when used for an array of devices, only one of which is shown in FIG. 11) comprises a very thin lightweight image intensifier of a compact, easy to use size.

Figure 12:
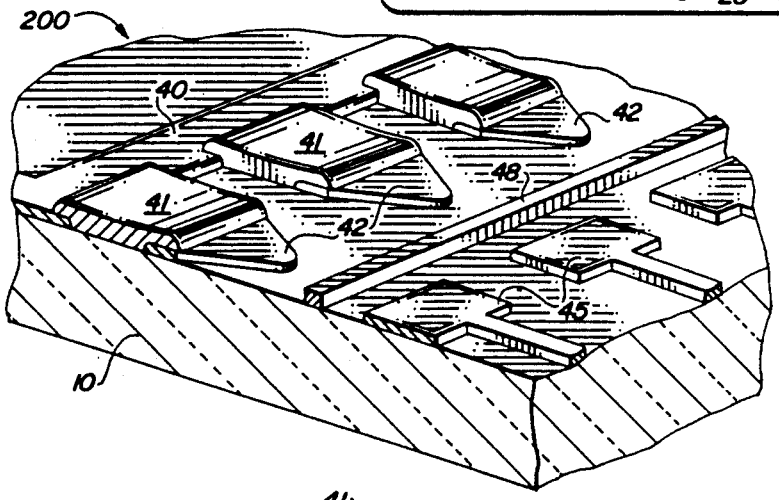
FIG. 12 is a partially cut-away perspective view of an alternative embodiment of the invention.
Figure 13:
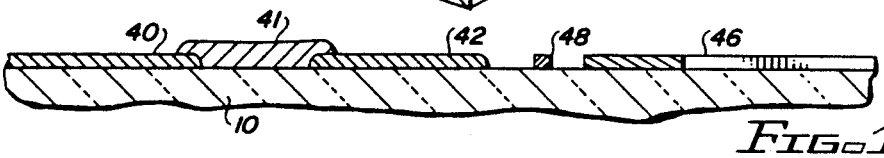
FIG. 13 is a cross-sectional view of the embodiment shown in FIG. 12.

FIGS. 12 and 13 are directed to a planar field emitter array which operates in substantially the same manner as the arrays described above in conjunction with the embodiments of FIGS. 1 through 6, and as utilized in the operating devices of FIGS. 9 through 11. The array shown in FIGS. 12 and 13, however, is not constructed as a conventional vertical stack of devices. Instead, the array is constructed with fewer layers and is arranged in such a way that other control structures, such as grids or their microscopic equivalents, may be employed Thus, the array of FIGS. 12 and 13 resembles vacuum tubes in operation.

The planar field emitter array and the planar controlled field emitter array is illustrated in the partially cut-away perspective view of FIG. 12. The packing density of the array of FIGS. 12 and 13 is comparable to the packing density of the arrays described in conjunction with the other embodiments and employs the same principles of operation. A silicon substrate 10 is provided. This substrate may be transparent, but it is not necessary for the substrate to be transparent because the variable impedances employed with the embodiment of FIGS. 12 and 13 are exposed on the upper surface of the array. The array itself is constructed on the substrate 10 by means of either a single or multiple layer of metallization deposited using conventional semiconductor metallization techniques.

As illustrated, the common lead 20 to the power supply of the embodiments of FIGS. 2 through 7 is replaced with a common power supply lead 40, shown on the left-hand side of both FIGS. 12 and 13. Spaced from this lead, and arranged in a parallel row, are a plurality of individual isosceles triangular shaped cathodes in the form of flat pointed metal elements which are etched from the same metallized layer as the lead 40. The tips of these triangular cathodes point toward the right in FIGS. 12 and 13, and a plurality of spaced anodes or gate electrodes 45 are provided at the right-hand side of the structure shown in FIGS. 12 and 13. The anodes 45 correspond substantially to the anode plates 15, and the cathodes 42 correspond to the cathode emitters 12 of the embodiments of FIGS. 2 through 7. The device of FIGS. 12 and 13, however, incorporates an additional element in the form of a conductive grid 48, which also may be formed at the same time as the elements 40, 42, and 45, out of the same metallization-etch sequence The grid 48 simply comprises a metal line between the cathodes 42 and the anodes 45. The grid 48 may be utilized to provide a control similar to that at a conventional triode or a more complex conventional vacuum tube.

After formation of the metal elements, as described above, individual variable impedances 41 are formed between the bases or widened portions of each of the cathodes 42 and the input conductive lead 40. The impedance of each of the impedances 41 is varied in accordance with a stimulus or condition to be sensed in the same manner as described in conjunction with the embodiments of FIGS. 2 through 7.

After formation, the device of FIGS. 12 and 13 is mounted in a vacuum and is provided with electrical bias connections comparable to those shown in FIG. 5. The impedances 41 may be applied as a separate deposit, as illustrated in FIG. 13 or they may be an integral part of the substrate 10, formed in a manner comparable to the formation of such impedances, as described above in conjunction with the embodiment of FIG. 7.

The planar configuration permits single or multiple control grids to be included without any additional processing complexity. In addition, the structure of FIGS. 12 and 13 is radiation hard The device of FIGS. 12 and 13, as well as the devices of FIGS. 2 through 7, is a high speed device since the electron flow is within the vacuum space and is not limited by semiconductor mobility. As described previously, the vacuum space is very small. The applications for the structure of FIGS. 12 and 13 are the same as those described above in conjunction with the embodiments of FIGS. 2 through 7. In addition, however, applications which utilize a control grid 48, also are possible The control grid emmulates vacuum triodes or transistors, which permit uses of the device shown in FIGS. 12 and 13 in all present applications for transistors and integrated semiconductor circuits. The speed of the devices shown in FIGS. 12 and 13 is considerably higher than that of conventional semiconductor integrated circuits and can be orders of magnitude higher. Consequently, this advantage opens the way for the use of the devices of FIGS. 12 and 13 in high speed computational and parallel optically coupled computational applications.

The foregoing description of the preferred embodiments of the invention is to be considered illustrative of the invention and not as limiting. Various changes and modifications will occur to those skilled in the art without departing from the true scope of the invention. The various applications which have been described are not exhaustive and are simply provided for the purpose of illustrating types of applications with which the devices of the invention may be used. Changes and modifications of the structural details, materials and fabrication techniques will occur to those skilled in the art without departing from the true scope of the invention as defined in the appended claims.

I claim:

1. A solid state electron amplifier including in combination:

a substrate;

a conductor on said substrate;

an electron emitter cathode member with an enlarged base and a pointed tip;

variable impedance means in series electrical circuit with said conductor and the base of said cathode member;

an anode member spaced a predetermined distance from said emitter cathode member;

means for applying an electrical bias voltage between said conductor and said anode member.

2. The combination according to claim 1 wherein said emitter cathode member comprises a field emission cathode member.

3. The combination according to claim 2 further including means for varying the impedance of said variable impedance means.

4. The combination according to claim 3 further including a non-conductive dielectric spacer means for supporting said anode member a predetermined distance from the base of said emitter member.

5. The combination according to claim 4 wherein said conductor comprises a conductor plate on the surface of said substrate member, and said impedance means is located between said conductor plate and the enlarged base of said emitter cathode member.

6. The combination according to claim 5 wherein said impedance means is a variable impedance means, the impedance of which is varied in response to exposure of said impedance means to a predetermined condition.

7. The combination according to claim 6 wherein said substrate is transparent to said predetermined condition.

8. The combination according to claim 7 wherein said conductor is transparent to said predetermined condition.

9. The combination according to claim 8 wherein said impedance means is embedded in the surface of said substrate beneath the base of said emitter cathode member.

10. The combination according to claim 7 wherein said predetermined condition comprises visible or infrared light.

11. The combination according to claim 7 wherein said predetermined condition comprises photoelectrons.

12. The combination according to claim 7 wherein said predetermined condition comprises photons.

13. The combination according to claim 8 wherein said emitter cathode members are metal members.

14. The combination according to claim 13 wherein said emitter cathode member comprises a field emission cathode member of a substantially conical shape, with said impedance means located between said substrate and the base of said cathode member, and with said anode member supported a predetermined distance from said substrate.

15. The combination according to claim 14 wherein said anode member comprises a plate of conductive material having a hole through the plate centered over said emitter cathode member, with the tip of said emitter cathode member directed substantially toward the center of such hole.

16. The combination according to claim 15 further including a vacuum housing for said amplifier.

17. The combination according to claim 16 further including a phosphor screen spaced a predetermined distance from said anode, with means for providing an electrical bias voltage between said anode member and said phosphorus screen for production of an image thereon corresponding to the impedance of said impedance means.

18. The combination according to claim 1 wherein said substrate has a substantially planar support surface and said conductor, said cathode member, said impedance means, and said anode member all are located on said support surface substantially in a plane parallel to the plane of said support surface of said substrate.

19. The combination according to claim 18 wherein said cathode member has a substantially triangular configuration in the form of an isosceles triangle, with the base thereof interconnected by said impedance means to said conductor and with the tip thereof pointed toward said anode member.

20. The combination according to claim 19 further including conductive grid means located on said substrate between the tip of said emitter cathode member and said anode member.

21. The combination according to claim 18 wherein said emitter cathode member comprises a field emission cathode member.

22. The combination according to claim 21 further including means for varying the impedance of said variable impedance means.

23. The combination according to claim 22 wherein said impedance means is a variable impedance means, the impedance of which is varied in response to exposure of said impedance means to a predetermined condition.

24. The combination according to claim 23 wherein said predetermined condition comprises visible or infrared light.

25. The combination according to claim 23 wherein said predetermined condition comprises photoelectrons.

26. The combination according to claim 23 wherein said predetermined condition comprises photons.

27. The combination according to claim 1 further including a non-conductive dielectric spacer means for supporting said anode member a predetermined distance from the base of said emitter member.

28. The combination according to claim 1 wherein said emitter cathode member comprises a field emission cathode member of a substantially conical shape, with said impedance means located between said substrate and the base of said cathode member, and with said anode member supported a predetermined distance from said substrate.

29. The combination according to claim 28 wherein said anode member comprises a plate of conductive material having a hole therethrough centered over said emitter cathode member, with the tip of said emitter cathode member directed substantially toward the center of such hole.

30. The combination according to claim 1 wherein said impedance means is embedded in the surface of said substrate beneath the base of said emitter cathode member.

31. The combination according to claim 1 wherein said conductor comprises a conductor plate on the surface of said substrate member, and said impedance means is located between said conductor plate and the enlarged base of said emitter cathode member.

32. The combination according to claim 1 wherein said impedance means is a variable impedance means, the impedance of which is varied in response to exposure of said impedance means to a predetermined condition.

33. The combination according to claim 32 wherein said substrate is transparent to said predetermined condition.

34. The combination according to claim 33 wherein said conductor is transparent to said predetermined condition.

35. A solid state electron amplifier array including in combination:

a substrate;

conductor means on said substrate;

a plurality of field emission electron emitter cathode members, each having an enlarged base and a pointed tip;

separate impedance means between said conductor and the base of each of said emitter cathode members;

anode members associated with each-of said emitter cathode members, said anode members being spaced a predetermined distance from the bases of the associated emitter cathode members;

means for applying an electrical bias voltage between said conductor and said anode members.

36. The combination according to claim 35 wherein said impedance means comprise variable impedance means, and further including means for varying the impedance of said variable impedance means.

37. The combination according to claim 36 wherein said means for varying the impedance of said variable impedance means comprises means for individually varying the impedance of each of said variable impedance means.

38. The combination according to claim 37 wherein said impedance means is a variable impedance means, the impedance of which is varied in response to exposure of said impedance means to a predetermined condition.

39. The combination according to claim 38 wherein said substrate is transparent to said predetermined condition.

40. The combination according to claim 39 wherein said conductor is transparent to said predetermined condition.

41. The combination according to claim 39 wherein said predetermined condition comprises visible or infrared light.

42. The combination according to claim 39 wherein said predetermined condition comprises photoelectrons.

43. The combination according to claim 39 wherein said predetermined condition comprises photons.

44. The combination according to claim 35 wherein said substrate has a substantially planar support surface and said conductor, said cathode member, said impedance means, and said anode member all are located on said support surface substantially in a plane parallel to the plane of said support surface of said substrate.

45. The combination according to claim 44 wherein said cathode member has a substantially triangular configuration in the form of an isosceles triangle, with the base thereof interconnected by said impedance means to said conductor and with the tip thereof pointed toward said anode member.

46. The combination according to claim 45 further including conductive grid means located on said substrate between the tip of said emitter cathode member and said anode member.

47. The combination according to claim 35 wherein said emitter cathode members are metal members.

48. The combination according to claim 35 further including a vacuum housing for said amplifier.

49. The combination according to claim 48 further including a phosphor screen spaced a predetermined distance from said anode, with means for providing an electrical bias voltage between said anode member and said phosphorus screen for production of an image thereon corresponding to the impedance of said impedance means.

* * * * *